United States Patent [19]

Kühn

[11] Patent Number: 4,465,145

[45] Date of Patent: Aug. 14, 1984

[54] CUSHIONED DRIVE CAP FOR A PILE DRIVER

[75] Inventor: Hans Kühn, Hamburg, Fed. Rep. of Germany

[73] Assignee: Koehring GmbH, Ellerau, Fed. Rep. of Germany

[21] Appl. No.: 337,241

[22] Filed: Jan. 4, 1982

Related U.S. Application Data

[63] Continuation of Ser. No. 127,837, Mar. 6, 1980, abandoned, which is a continuation of Ser. No. 951,308, Oct. 13, 1978, abandoned, which is a continuation of Ser. No. 751,815, Dec. 20, 1976, abandoned.

[30] Foreign Application Priority Data

Dec. 20, 1976 [DE] Fed. Rep. of Germany ..... 2557704

[51] Int. Cl.[3] ..... B25D 9/00; E21B 11/02

[52] U.S. Cl. ..... 173/131; 173/1; 173/139; 267/137

[58] Field of Search ..... 173/128, 131, 133, 139, 173/125, 1; 175/19, 20, 21; 267/137, 113, 182; 405/232

[56] References Cited

U.S. PATENT DOCUMENTS

| | | | |
|---|---|---|---|
| 886,193 | 4/1908 | Dewitt | 173/131 |
| 3,417,828 | 12/1968 | Duyster et al. | 173/125 |
| 3,456,741 | 7/1967 | James | 173/119 |
| 3,498,391 | 3/1970 | Guild et al. | 173/131 |
| 3,797,585 | 3/1974 | Ludvigson | 173/131 |
| 3,991,833 | 11/1976 | Ruppert | 173/131 |
| 4,036,310 | 7/1977 | Schnell | 173/131 |

FOREIGN PATENT DOCUMENTS

| | | | |
|---|---|---|---|
| 257805 | 3/1913 | Fed. Rep. of Germany | 173/131 |
| 213741 | 10/1968 | U.S.S.R. | 173/139 |
| 238409 | 12/1969 | U.S.S.R. | 173/131 |
| 281264 | 10/1971 | U.S.S.R. | 173/131 |
| 293100 | 3/1972 | U.S.S.R. | 173/131 |

*Primary Examiner*—Frank T. Yost
*Assistant Examiner*—H. Phan
*Attorney, Agent, or Firm*—Michael J. Striker

[57] ABSTRACT

A force-transmitting a drive caps is interposable between a pile driver hammer and a pile to be driven. This cap is formed with an upwardly open cylinder which is of smaller area than the striking face of the hammer. A piston is vertically reciprocal in this cylinder and has an upper surface which is engageable with the striking face of the hammer. The chamber below the piston in the drive cap contains a body of liquid and a body of gas. The gas is pressurized so as to urge the piston into a raised position extending upwardly from the upper face of the drive cap. The piston and hammer are dimensioned so that the hammer first strikes the piston, driving it downwardly in the cylinder, and thereafter strikes the upper surface of the drive cap. The gas body may be held in a separate container within the chamber in te drive cap and the pressure of the gas body is established by the amount of liquid in this chamber.

13 Claims, 8 Drawing Figures

CUSHIONED DRIVE CAP FOR A PILE DRIVER

This is a continuation of application Ser. No. 127,837, filed Mar. 6, 1980 now abandoned, which is a continuation of application Ser. No. 951,308 filed Oct. 13, 1978, now abandoned, which in turn is a continuation of application Ser. No. 751,815 filed Dec. 20, 1976, now abandoned.

BACKGROUND OF THE INVENTION

The present invention relates to a force-transmitting drive cap for use between the hammer of a pile driver and the end of a pile being driven.

A pile driver of the non-vibratory type usually has a hammer which is reciprocated in a normally vertical direction so as to strike the upper end of a pile each time it descends, thereby driving this pile into the ground or other substrate. Normally the hammer, which may be a simple ram that is lifted hydraulically and then dropped in order to reciprocate, does not strike directly against the upper end of the pile, but strikes against a drive cap sitting on the upper end of the pile. The drive cap is of relatively hard material, normally hardened steel, whereas the pile is of a softer material, normally mild steel or even wood. Thus smooth force transmission takes place through this drive cap to the pile so that the hardened steel hammer of the pile driver does not mushroom the upper end of the pile.

It is known to provide a shock-absorbing bumper on or in the drive cap so that the enormous forces that are applied virtually instantaneously to the drive cap are transmitted to the pile over a longer period of time, thereby preventing deformation of the pile as the drive force peaks. In the simplest arrangements such a force-transmitting and force-absorbing cushion is a simple block of wood or elastomeric material that is used until it is itself destroyed, whereupon it is replaced by another such cushion or bumper.

In a known system a hydraulic or mixed hydraulic/-pneumatic bumper is provided in the drive cap. In such systems the upper side of the drive cap, that is the side engaged by the pile-driver hammer, is separate from the lower side, that is the side resting on the upper end of the piston, and a compressed gas cushion is provided between them. The hammer strikes the upper side with a force sufficient to compress the gas cushion, but not with a force exceeding the upwardly effective force of the cushion on the upper side. Thus the pressurization of the chamber in the drive cap sets a limit to the force with which the hammer can strike this drive cap. Such devices cannot be used for the driving of piles in very hard ground as it is impossible to apply enough force through such a drive cap to the pile without destroying the drive cap or mushrooming the upper end of the pile. When extreme force is needed it is necessary to use the above-mentioned bumpers of wood, asbestos, or a hard synthetic resin.

Another disadvantage of the known cushioned drive caps is that they cannot be adjusted for use in driving piles in grounds having different characteristics or resistance to penetration of the pile.

SUMMARY OF THE INVENTION

It is therefore an object of the present invention to provide an improved force-transmitting drive cap for use in a hammer-type pile driver.

Yet another object is to provide such a drive cap which overcoms the above-given disadvantages, which has a long service life, and which can be produced at low cost.

These objects are attained according to the present invention in a rigid force-transmitting drive cap having one side turned toward the striking face of the hammer and another opposite side turned in opposite direction toward and engageable with the pile. This cap is in the form of a cylinder that extends in the hammer displacement direction, opens at the one side turned toward the hammer, and is of a smaller area at the one side than the striking face of the hammer. This cylinder on the one side thereof is formed with an annular impact surface that also in engageable with the striking face. A piston having a piston face engageable with the striking face of the hammer is reciprocal in the cylinder between a raised position in which its piston face projects beyond the annular impact surface and a depressed position in which the piston face is level with the annular surface. Thus the striking face of the hammer on displacement toward the pile first strikes the piston surface and then the annular impact surface after pushing the piston from the raised position into the depressed position. The piston sealingly closes the cylinder and defines therewith a substantially closed chamber in which is provided a body of noncompressible liquid and a body of compressible gas. Means is provided for pressurizing the body of gas to a predetermined pressure so as to urge the piston into the raised position.

Thus with the system according to the present invention the striking face of the hammer comes into contact with the piston surface so as on one hand to transmit force against the pile through the bodies of liquid and gas in the chamber of the drive cap, and on the other hand to store up energy in the body of gas by compressing it. Once the hammer has depressed the piston until its surface is level with this upper surface of the drive cap, it comes into contact with the drive cap and therefore into direct force-transmission engagement through the drive cap with the upper end of the pile. When the hammer moves upwardly away from the drive cap the stored-up energy in the gas body is effective to continue driving the pile, thereby effectively and considerably increasing the effective stroke of the hammer.

According to another feature of this invention the pressurization of the gas body in the chamber of the drive cap is such that it creates an upward force equal to between 10% and 60%, preferably between 20% and 50% of the resistance to penetration of the non-moving pile. The superatmospheric pressure in the gas body is so great that at least 50%, and preferably between 10% and 40% of the hammer force are transferred to the pile by the impact of the striking surface on the annular surface of the cap.

According to another feature of this invention the gas body inside the chamber of the drive cap is held in a container having at least one wall which is movable so that the volume of the gas body can change. This container is substantially completely surrounded by the liquid body. The displaceable wall portion may be constituted as a slidable piston, or as a relatively light membrane. The use of a membrane prevents diffusion of the gas body into the liquid body by leakage from the container, and greatly decreases the inertia of the system. Thus the gas body is capable of rapidly changing volume on displacement of the piston down into the chamber from the raised position, so that the system can respond immediately. It is also possible according to this invention to have a gas body which is simply a pocket of gas overlying the liquid body in the chamber of the drive cap.

When the gas body is held in a container within the liquid body, bumpers or elastic mounts are provided between the container and the cap. These mounts permit displacement of the gas-holding container in the direction of displacement of the drive cap within the chamber. Thus when the drive cap is struck by the hammer, the container can move limitedly longitudinally of the arrangement.

According to yet another feature of this invention the drive cap is provided on its one side around the cylinder with a separate striking ring that forms the annular surface engageable with the striking face of the hammer. Elastically deformable material is provided between this striking ring and the body of the drive cap so that the striking ring is limitedly displaceable in the direction relative to the drive cap, for further cushioning of the blow and in order to prevent deformation of the pile.

The drive cap is formed in accordance with this invention with a shoulder in the inner wall of the cylinder against which a step on the piston abuts so that the piston extends between 3.0 mm and 30 mm above the strike ring when the piston in the raised position. A seal may be provided between this step and shoulder.

In accordance with yet another feature of this invention the means for pressurizing the body of gas includes a passage formed in the drive cap and extending between an exterior surface of this drive cap and the chamber. At least one valve is provided in this message, and two additional passages may be provided, each with a respective valve. Thus the pressure of the gas body is controlled by varying the amount of liquid in the chamber. It is also within the scope of this invention to provide a pressure-relief valve in the passage set at the desired superatmospheric pressure, so that if, for instance, heat causes the liquid in the drive cap to expand, the pressure will not be disadvantageously increased as the excess pressure will drain off.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
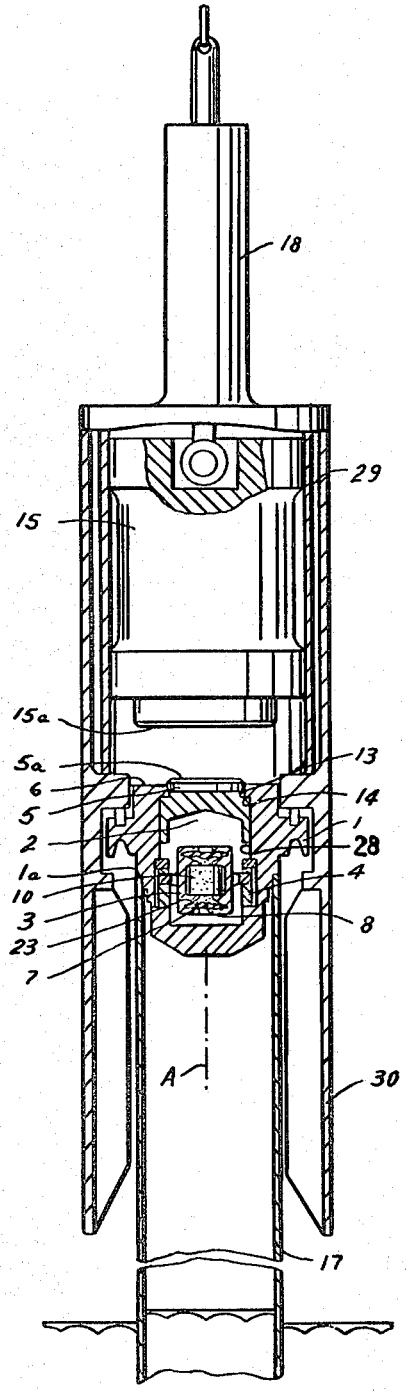
FIG. 1 is a longitudinal vertical section through the pile drive according to this invention.
Figure 2:
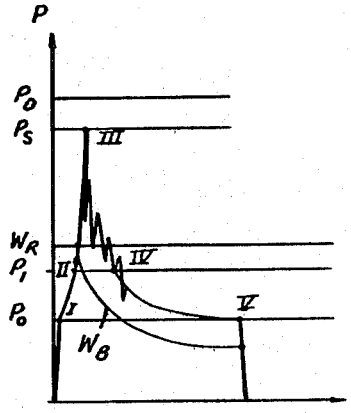
FIG. 2 is a graph illustrating operation of the pile driver of FIG. 1.
Figure 3:
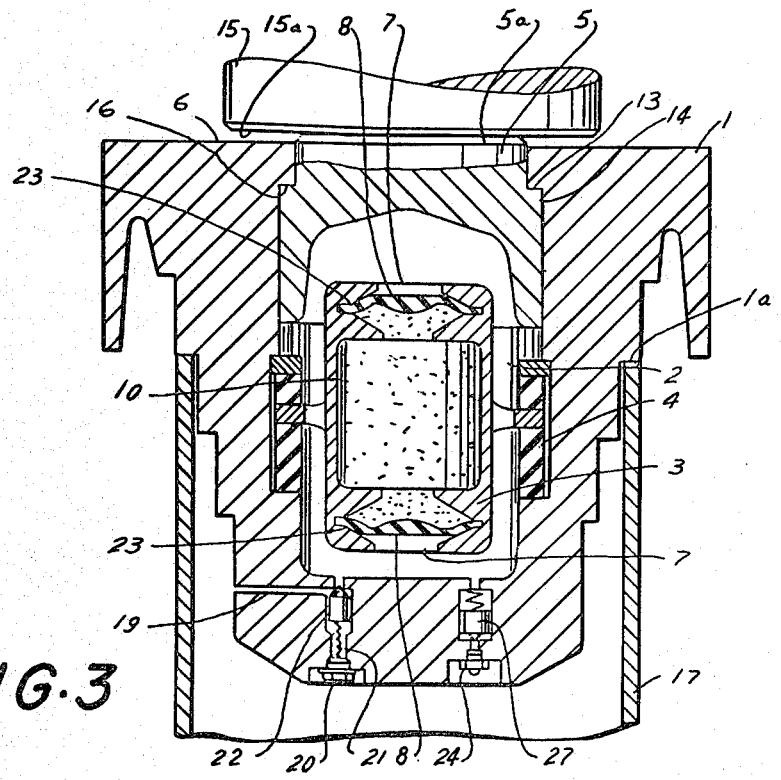
FIG. 3 is a large-scale view of a detail of FIG. 1.

As shown in FIGS. 1–3 a pile-driver has a hammer 15 reciprocal by an upwardly effective hydraulic cylinder 18 inside a vertical cylindrical guide 29 in line with a vertical axis A. A cylindrical support sleeve 30 carries the guide 29 and cylinder 18 and is centered on the axis A. The upper end of a pile 17, here of cylindrical shape and being driven into the ground, extends into the lower region of the guide or centering sleeve 30.

The hammer 15 is effective on the pile 17 through a drive cap 1 shown in best detail in FIG. 3. This drive cap 1 has on its lower side a plurality of surfaces 1*a* against which piles such as 17 can fit. Thus the drive cap 1 sits on top of the pile 17. The hammer 15 has a planar circular surface 15*a* which extends orthogonal to the axis A and is engageable with a planar and circularly annular surface 6 formed on the upper surface of the drive cap 1 around the mouth of a cylinder centered on the axis A and formed in the drive cap 1.

Figure 6:
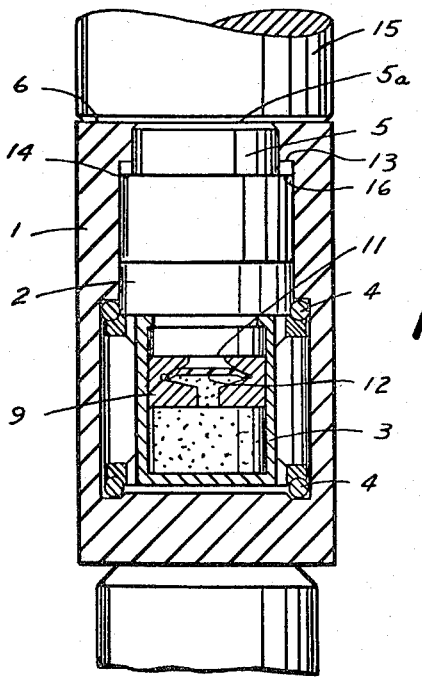

A piston 5 symmetrical about the axis A is reciprocal along this axis A in the cylinder formed in the drive cap 1 and has a planar and circular upper surface or face 5*a* flatly engageable with the center portion of the surface 15*a* of the hammer 15. This piston 5 is downwardly cupped and is formed with a shoulder 14 engageable under a step 13 in the drive cap 1 so that in the illustrated raised position of FIG. 3 this piston 5 extends above the surface 6 by a distance equal to between 3.0 mm and 30 mm. The piston 5 is provided at its shoulder 14 with a seal ring 16 (FIG. 6).

A body 2 of liquid, hydraulic fluid or oil, is provided in the chamber defined by the piston 5 in the cylinder 28. This liquid is introduced into the bottom of the cylinder 28 through an inlet passage 24 which is closable by means of a plug and which is provided with a check valve 27 only allowing liquid entry into the cylinder 28. Another passage 19 is formed between the cylinder 28 at the bottom thereof and an exterior surface of the drive cap 1 and is provided with a pressure-relief valve 22 permitting liquid to exit from the chamber when it is above a pressure established by means of a setting screw 20 bearing via a spring 21 on the valve body of this valve 22.

Within the liquid body 2 there is provided a container 3 holding a body 10 of gas. This container 3 is completely surrounded by the liquid body and is supported via elastic springs 4 in the cylinder 28 for limited displacement along axis A relative to the drive cap 1. The container 3 is formed on its upper and lower sides with holes 7 hermetically sealed by membranes 8 that are outwardly deflectable and engageable against surfaces 23 of the body 3.

The cap functions as follows, with reference to FIG. 3 in which the abscissa represents time, and there is shown on the ordinate the pressure exerted by hammer 15. Pressure $P_o$ is equal to the pressure necessary to displace the piston 5 relative to the cap 1. Pressure $P_l$ is equal to the pressure which the hammer must exert on the piston 5, and therethrough on the pile 17 of course, to bring the surface 5*a* of the piston 5 into a position flush with the surface 6. Pressure or force $W_R$ is the resistance to penetration offered by the stillstanding pile 17. $P_S$ is the maximum force transferred and $P_D$ is that force which, if applied to the pile 17, would deform the pile 17 permanently. Plotted line $W_B$ shows the resistance to displacement of the pile 17 once it is moving, thus its dynamic resistance as compared to its static resistance $W_R$.

As the hammer 15 descends the pressure it exerts quickly rises to point I at a pressure $P_o$ at which the piston 5 starts to move downwardly relative to the cap 1. Thereafter, as energy is stored in the body 10 which is, therefore, compressed, the pressure exerted increases more slowly to point II when the surface 5*a* is level with the surface 6. Thereafter the pressure exerted by the hammer 15 rises sharply through level $W_R$ to its maximum force at point III. As soon as the pressure exceeds $W_R$ the pile starts to move downwardly.

After point III the hammer 15 starts to move back upwardly along axis A. But the pressure effective on the pile 17 continues past point IV to point V so during this entire time period the pile 17 is continuously pushed into the ground. The stored-up energy in the gas body 10 is largely responsible for this stretching-out of the effective stroke of the hammer 15. It is therefore possible to operate this arrangement at such a speed that the pile 17 never actually stops moving, so that extremely efficient pile-driving is achieved. Furthermore since the maximum force never reaches level $P_D$ deformation of the pile is completely eliminated and the use of disposable cushions and the like is not necessary.

Once the piston 5 is raised all the way up so that its shoulder 14 abuts the step 13 the driving action is ended. In this position the body 10 of gas is returned to the superatmospheric pressure established by the valve 22.

Figure 4:
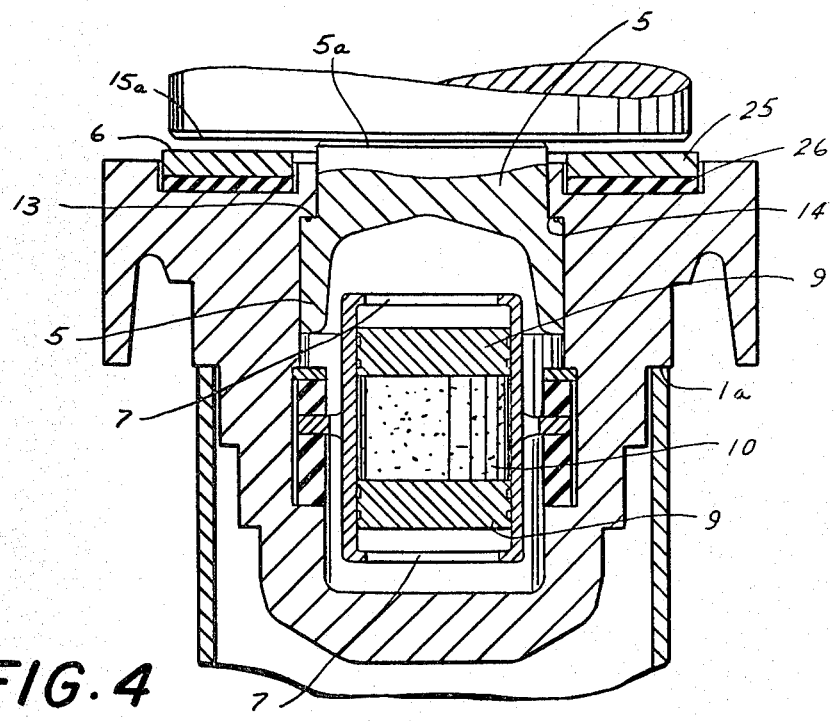

In the system shown in FIG. 4 the body 10 is held in the container 3 between a pair of slidable pistons 9 which take the place of the membranes 8. In addition the surface 6 in this arrangement is formed on a ring 25 held on a ring 26 of elastic material in an upwardly open groove on the upper surface of the drive cap 1. Thus some cushioning is effective between points II-III with the arrangement of FIG. 4. In all other respects this arrangement is identical to that described with reference to FIGS. 1-3.

Figure 5:
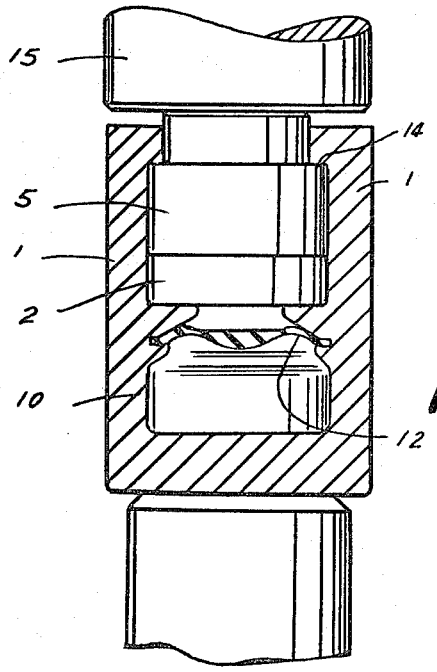
FIGS. 4–8 are vertical sections through further drive caps in accordance with this invention.

In the arrangement of FIG. 5 the gas body 10 is contained in a recess formed directly in the drive cap 1. A membrane 12 fitted in the drive cap 1 separates the gas body 10 from the overlying liquid body 2.

In FIG. 6 the gas body 10 is held in a container 3 whose one side is closed by means of a piston 9 having a membrane 12 closing a hole 11 in this piston 9. It is noted that FIG. 6 shows the piston 5 in the depressed position with its surface 5*a* coplanar with the surface 6. Also the elastic mounts 4 are here shown as circular-section elastomeric rings.

Figure 7:
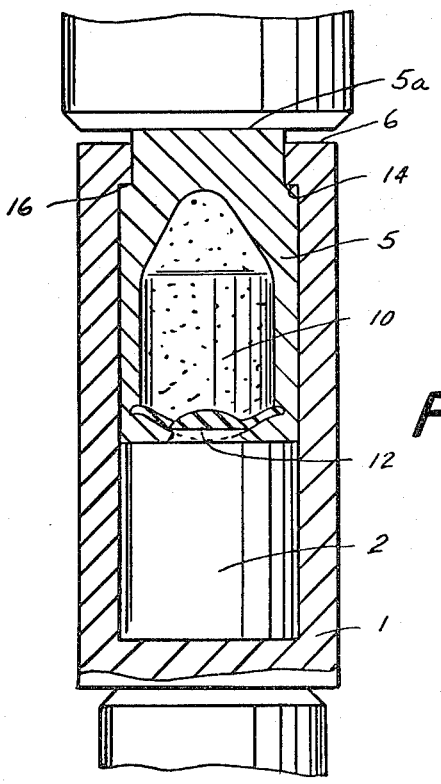

In FIG. 7 the piston 5 itself is formed with a recess holding the gas body 10, and is provided with a membrane 12. Here the liquid body 2 lies below the gas body 10.

Figure 8:
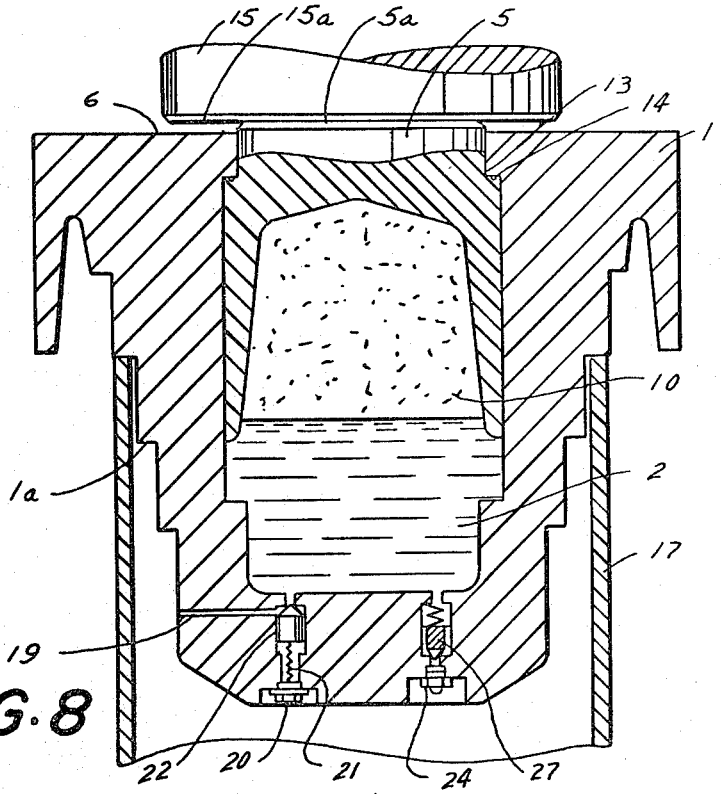

Finally FIG. 8 shows an arrangement wherein the gas body 10 overlies the liquid body 2, but no membrane or piston is provided between the two. In all other respects the embodiment of FIG. 8 is identical to the embodiment of FIG. 1.

With the system according to the present invention it is therefore possible rapidly to drive piling, without the danger of deforming this piling. At the same time it is not necessary to provide shock-absorbing bumpers between the upper end of the pile and the drive cap, as the system itself prevents excessive forces from being exerted on the pile, while not reducing driving efficiency.

It will be understood that each of the elements described above, or two or more together, may also find a useful application in other types of structures differing from the types described above.

While the invention has been illustrated and described as embodied in a cap for use with a pile driver, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A force-transmitting cap interposable between a pile drive hammer and a driven pile, said cap comprising a hollow rigid cylinder element having a rigid circumferential wall, a closed axial end and an open axial bore at the other axial end; a piston sealingly guided in said bore for reciprocating movement and having an outer end face operative when hit for inwardly depressing the piston; an internal chamber in said bore sealed by said piston for receiving a pressurized body of gas and a body of liquid; at least one closable passage extending from said chamber to the outside of said cap for flowing gas or liquid into and out of said chamber; an impact surface disposed at said other axial end and dimensioned for direct, substantially uncushioned impact transfer, cooperating stop surfaces on said piston and said cylinder element operative to abut against each other for limiting the distance by which the piston can project outwardly beyond said impact surface to a predetermined distance D; means for limiting the pressure in the body of gas to a predetermined pressure value; said piston being guided in said bore for leakage-free inward depression to positions beyond the level of said impact surface; the wall of the cylinder element, the impact surface and the predetermined distance D being dimensioned to permit at said predetermined pressure value a two-step impact transfer transmitting part of the impact energy via the pressurized body of gas and the other part of the impact energy directly via the impact surface as substantially uncushioned force peak; a displaceable separating member accommodated in the interior of the hollow cylinder element and subdividing the interior of the cylinder element into two pressurization compartments; the separating member comprising a slidable internal piston having a central bore and a flexible separating diaphragm having a peripheral edge clamped in a circumferential groove in the inner circumferential surface of the slidable internal piston.

2. A force-transmitting cap interposable between a pile drive hammer and a driven pile, said cap comprising a hollow rigid cylinder element having a rigid circumferential wall, a closed axial end and an open axial bore at the other axial end; a piston sealingly guided in said bore for reciprocating movement and having an outer end face operative when hit for inwardly depressing the piston; an internal chamber in said bore sealed by said piston for receiving a pressurized body of gas and a body of liquid; at least one closable passage extending from said chamber to the outside of said cap for flowing gas or liquid into and out of said chamber; an impact surface disposed at said other axial end and dimensioned for direct, substantially uncushioned impact transfer, cooperating stop surfaces on said piston and said cylinder element operative to abut against each other for limiting the distance by which the piston can project outwardly beyond said impact surface to a predetermined distance D; means for limiting the pressure in the body of gas to a predetermined pressure value; said piston being guided in said bore for leakage-free inward depression to positions beyond the level of said impact surface; the wall of the cylinder element, the impact surface and the predetermined distance D being dimensioned to permit at said predetermined pressure value a two-step impact transfer transmitting part of the impact energy via the pressurized body of gas and the other part of the impact energy directly via the impact surface as substantially uncushioned force peak; a displaceable separating member accommodated in the interior of the hollow cylinder element; the separating member comprising a sealed container mounted in the interior of the cylinder element and subdividing the interior of the cylinder element into a first compartment and into a second compartment, the second compartment being internal to and enclosed by the first compartment.

3. A force-transmitting cap as defined in claim 2, furthermore including elastically yieldable mounting means mounting the sealed container in the interior of the hollow cylinder.

4. A force-transmitting cap as defined in claim 2, the elastically yieldable mounting means comprising bearing springs suspending the container in the interior of the hollow cylinder.

5. A force-transmitting cap as defined in claim 2, the sealed container being a generally rigid container having a displaceable wall which permits the volume of the second compartment to change during operation of the force-transmitting cap.

6. A force-transmitting cap for transmitting the blow of a pile-drive hammer to a pile, said cap having a rigid circumferential wall, a closed first axial end wall, an open axial bore at the other axial end, a second axial end wall around said bore, and a constricting shoulder forming an internal step in said bore; a piston sealingly guided in said bore for reciprocating axial movement between an outermost position and inwardly depressed positions, said piston having an outer end face operative when hit for inwardly depressing the piston, and having an external shoulder directly abutting in said outermost position against said constricting shoulder of the cap; a sole undivided internal chamber in said bore sealed by said piston for receiving a body of gas and a body of liquid in direct contact with each other; a valve-containing passage extending from said chamber to the outside surface of the cap for flowing gas or liquid from outside the cap into said chamber for precompressing said body of gas to a predetermined operating pressure P urging the piston with predetermined force directly against said abutting shoulder of the cap; the external side of said second axial end wall of the cap being designed as an impact surface for direct steel-to-steel impact transfer, said piston being guided in said bore for leakage-free inward depression of its outer end face beyond the level of the impact surface; the walls of the cap, the impact surface and a distance D by which the piston in its outermost position projects outwardly beyond the impact surface being dimensioned to obtain at said operating pressure P a two-step impact transfer transmitting to the pile during telescoping inward depression of said piston part of the impact energy as a cushioned resilient driving force via the precompressed body of gas, and the other part as a substantially uncushioned force peak by direct steel-to-steel impact via said impact surface and the rigid circumferential wall of the cap, while the precompressed body of gas maintains its resilient driving force on the pile.

7. A force-transmitting cap as defined in claim 6, the predetermined distance D being limited to a value between 3 and 30 mm.

8. A force-transmitting cap for transmitting the blow of a pile-driver hammer to a pile, said cap having a rigid circumferential wall, a closed first axial end wall, an open axial bore at the other axial end, a second axial end wall around said bore, and a constricting shoulder forming an internal step in said bore; a piston sealingly guided in said bore for reciprocating axial movement between an outermost position and inwardly depressed positions, said piston having an outer end face operative when hit for inwardly depressing the piston, and having an external shoulder directly abutting in said outermost position against said constricting shoulder of the cap; a closed internal chamber defined by the inner walls of said bore and said piston, separating means subdividing said chamber into a liquid compartment to be completely filled with a body of liquid, and a gas compartment completely filled with gas, said separating means comprising a flexible diaphragm having a peripheral edge sealingly clamped in a circumferential groove at an inner wall defining said chamber; at least one valve-containing passage extending from said chamber to the outside surface of the cap for flowing gas or liquid from outside the cap into said chamber for precompressing said body of gas to a predetermined operating pressure P urging the piston with predetermined force directly against said abutting shoulder of the cap; the external side of said second axial end wall of the cap being designed as an impact surface for direct steel-to-steel impact transfer, said piston being guided in said bore for leakage-free inward depression of its outer end face beyond the level of the impact surface; the walls of the cap, the impact surface and a distance D by which the piston in its outermost position projects outwardly beyond the impact surface being dimensioned to obtain at said operating pressure P a two-step impact transfer transmitting to the pile during telescoping inward depression of said piston part of the impact energy as a cushioned resilient driving force via the precompressed body of gas, and the other part as a substantially uncushioned force peak by direct steel-to-steel impact via said impact surface and the rigid circumferential wall of the cap, while the precompressed body of gas maintains its resilient driving force on the pile.

9. A force-transmitting cap as defined in claim 8, wherein said piston has an internal recess defining a space forming part of the internal chamber, said gas compartment is disposed in said recess and the peripheral edge of the flexible diaphragm is clamped in a circumferential groove in the inner circumferential wall of said recess.

10. A force-transmitting cap as defined in claim 8, wherein the separating means comprises a slidable auxiliary piston having a central opening and the flexible diaphragm is clamped in said opening of the auxiliary piston.

11. A force-transmitting cap as defined in claim 8, wherein the separating means comprise a sealed rigid container mounted in the internal chamber of the cap and subdividing said chamber into a liquid compartment and a gas compartment internal to and enclosed by the liquid compartment, said container having at least one displaceable wall element selected from a flexible diaphragm, a slidable auxiliary piston, and a slidable auxiliary piston having a central opening and a flexible diaphragm clamped in said opening.

12. A force-transmitting cap as defined in claim 11, furthermore including elastically yieldable mounting means mounting the sealed container in the internal chamber of the cap.

13. A force-transmitting cap as defined in claim 11, the elastically yieldable mounting means comprising bearing springs suspending the container in the internal chamber of the cap.

* * * * *